US005842578A

United States Patent [19]

Cordeiro

[11] Patent Number: 5,842,578

[45] Date of Patent: Dec. 1, 1998

[54] SCREENING APPARATUS AND CARRIER COMBINATION

[76] Inventor: James Cordeiro, 127 Bedford St., Lakeville, Mass. 02347

[21] Appl. No.: 826,201

[22] Filed: Mar. 27, 1997

[51] Int. Cl.[6] ..... B07B 1/49

[52] U.S. Cl. ..... 209/420; 209/935

[58] Field of Search ..... 209/420, 421, 209/935, 315, 355, 320, 324, 326

[56] References Cited

U.S. PATENT DOCUMENTS

| | | | |
|---|---|---|---|
| D. 263,836 | 4/1982 | Read | D15/147 |
| 4,197,194 | 4/1980 | Read | 209/325 |
| 4,237,000 | 12/1980 | Read et al. | 209/319 |
| 4,256,572 | 3/1981 | Read | 209/257 |
| 4,923,597 | 5/1990 | Anderson et al. | 209/420 |
| 5,469,972 | 11/1995 | St-Pierre et al. | 209/421 X |
| 5,482,165 | 1/1996 | Johnston | 209/420 X |

FOREIGN PATENT DOCUMENTS

| | | | |
|---|---|---|---|
| 0409659 | 1/1991 | European Pat. Off. | 209/420 |
| 2 223 963 A | 4/1990 | United Kingdom . | |

*Primary Examiner*—David H. Bollinger
*Attorney, Agent, or Firm*—John P. McGonagle

[57] ABSTRACT

A combination screening apparatus and carrier. The screening apparatus has three hydraulic leg assemblies which are adapted to lift and lower the screening apparatus off and onto a carrier. The legs are positioned and operable that a carrier may be slid directly under the screening apparatus without interference with the legs. The carrier has pivotable holding elements which engage grasping elements fixedly attached to said screening apparatus. The shape and configuration of the holding elements and grasping elements are such that the screening apparatus is self-aligning on the carrier. The carrier may be left under the screening apparatus or removed during screening operations.

7 Claims, 8 Drawing Sheets

6

SCREENING APPARATUS AND CARRIER COMBINATION

BACKGROUND OF THE INVENTION

This invention relates to screening apparatus for separating fine material from coarse material, and in particular to such an apparatus in combination with a portable carrier.

Previously, it has been known to provide portable screening apparatus for separating fine materials from coarse material, wherein the portability of the apparatus is dependent upon wheels attached to the chassis of the apparatus. The wheels are generally made movable relative to the apparatus chassis from an operative position for transporting the apparatus to an inoperative position for resting the frame flush on the ground. Such a unit is shown, for example in U.S. Pat. Nos. 4,923,597; 4,256,572; 4,237,000; 4,197,194; and Des. 263,836, as well as U.K. Patent No. 2,223,963A. An apparatus, with attached wheels, is registered with the various state governments as a road vehicle and towed to the various desired locations for operation. The generally bulkiness of the apparatus makes it difficult to transport, especially since the apparatus is designed primarily as a screening apparatus rather than as a road vehicle.

An alternate to the above towed apparatus has historically been to mount or carry the screening apparatus on a trailer or truck. Since trailers and trucks are designed primarily as road vehicles, the inherent dangers of towing a screening apparatus are eliminated. However, operating the screening apparatus on a trailer or truck requires elaborate conveyors or chutes because of the mounted height of the screening apparatus. This approach has been considered unsatisfactory, because of inherent operating difficulties, as well as instability and danger from toppling. To set the screening apparatus directly on the ground, a crane is required to lift the screening apparatus from the trailer or truck to position it on the ground for screening operation.

To overcome the limitations of the prior art, applicant devised an apparatus that could both separate fine materials from coarse materials and mix two or more fine materials together. The apparatus was transportable in combination with a carrier. The apparatus was self-loading onto and off the carrier without the need for a crane.

SUMMARY OF THE INVENTION

The present invention provides a combination screening apparatus and carrier. The screening apparatus has three hydraulic leg assemblies which are adapted to lift and lower the screening apparatus off and onto a carrier. The legs are positioned and operable that a carrier may be slid directly under the screening apparatus without interference with the legs. The carrier has pivotable holding elements which engage grasping elements fixedly attached to said screening apparatus. The shape and configuration of the holding elements and grasping elements are such that the screening apparatus is self-aligning on the carrier. The carrier may be left under the screening apparatus or removed during screening operations.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there are illustrated two preferred embodiments of the invention.

DETAILED DESCRIPTION OF THE INVENTION

Figure 1:
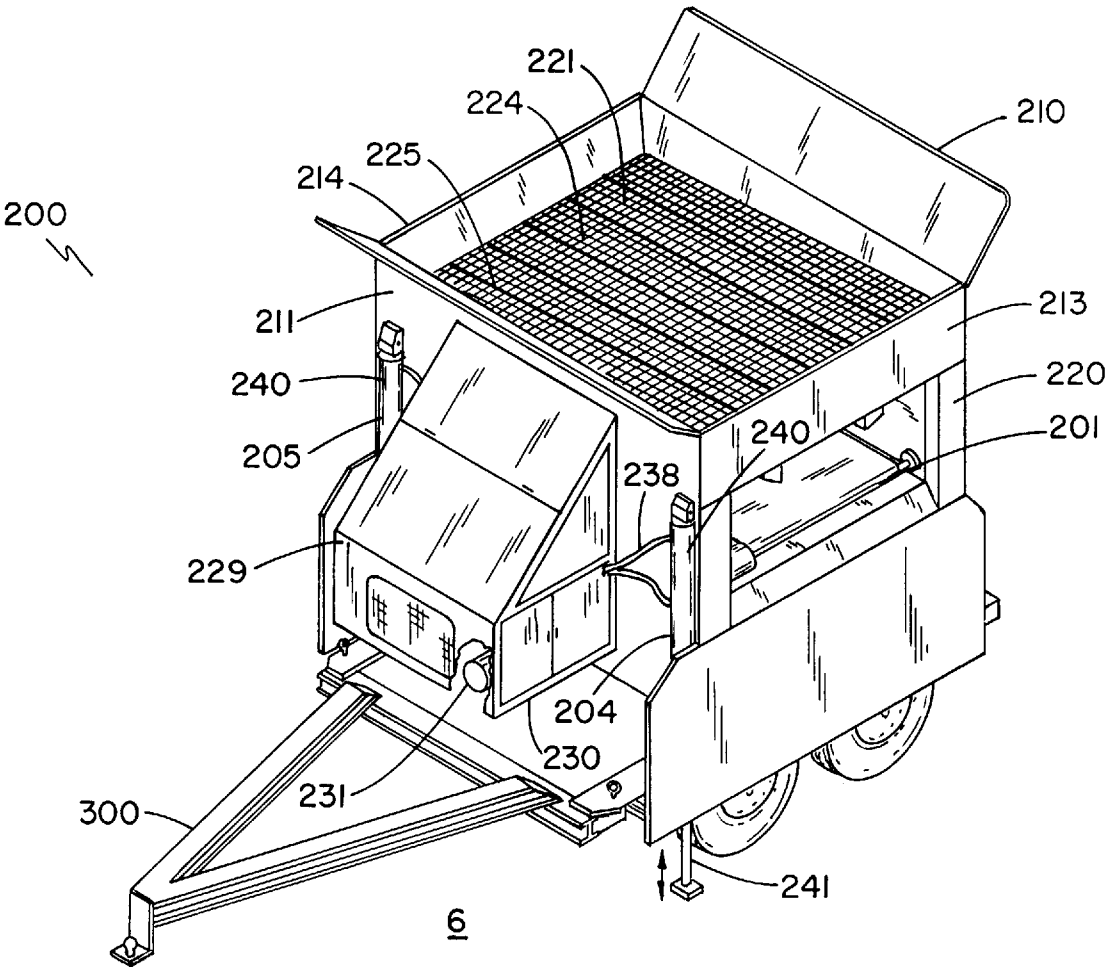
FIG. 1 is a front perspective view of a screening apparatus mounted on a carrier in accordance with the invention.
Figure 2:
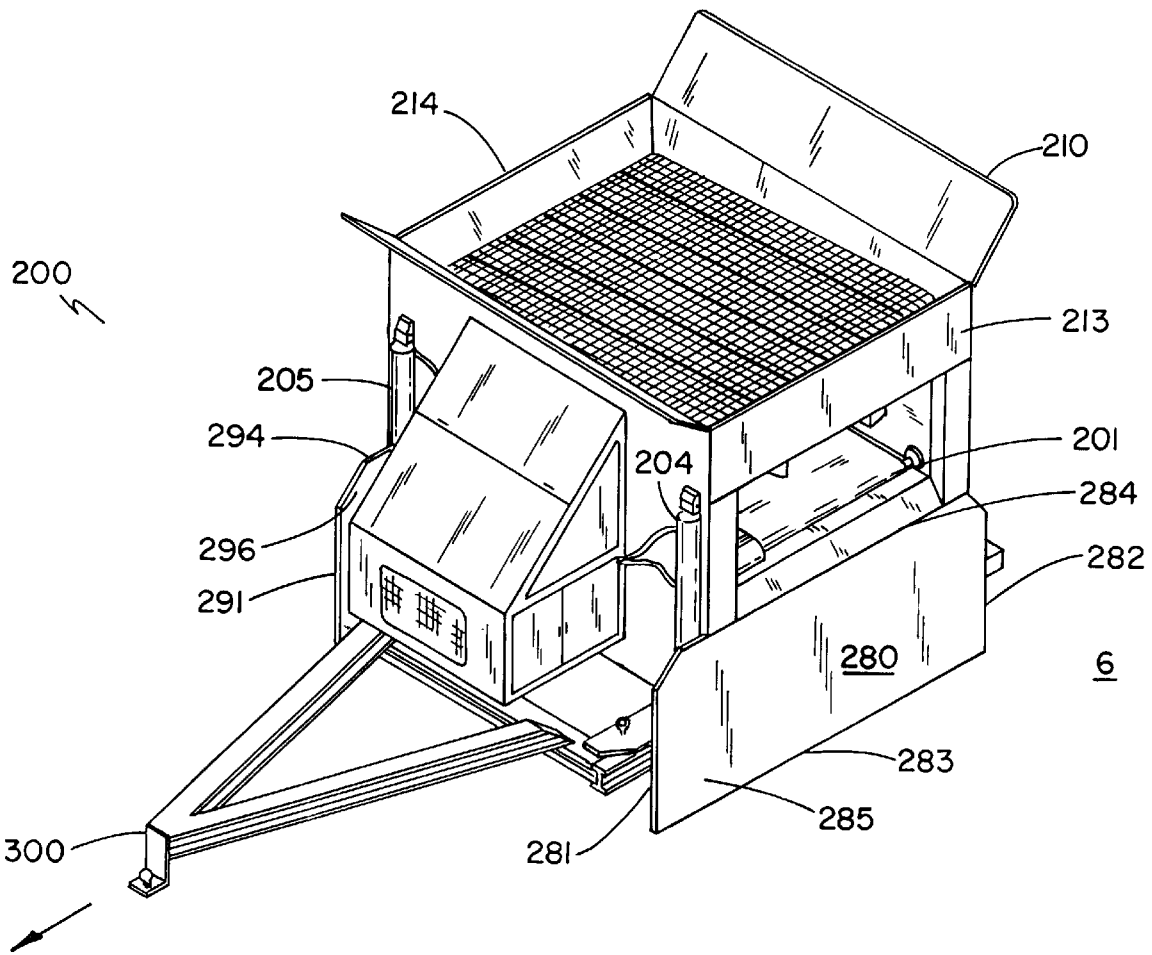
FIG. 2 is a front perspective view of the screening apparatus of FIG. 1 dismounted from the carrier with the carrier still in place beneath the screening apparatus.
Figure 4:
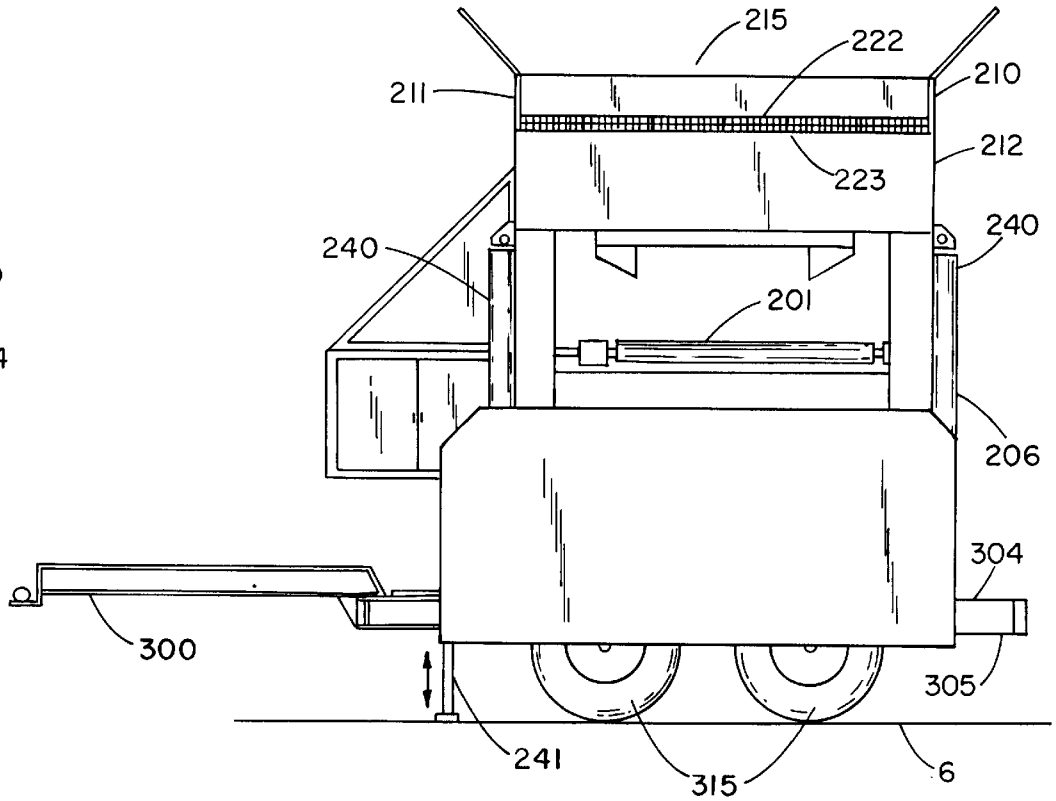
FIG. 4 is a conveyor side view of the invention.
Figure 3:
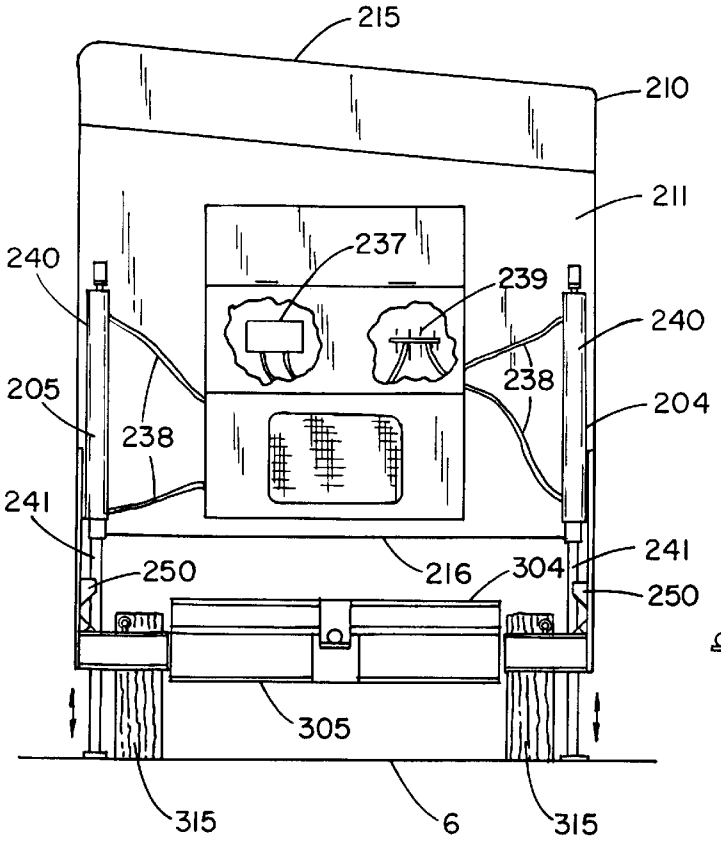
FIG. 3 is a front view of the screening apparatus being lowered onto the carrier.
Figure 6:
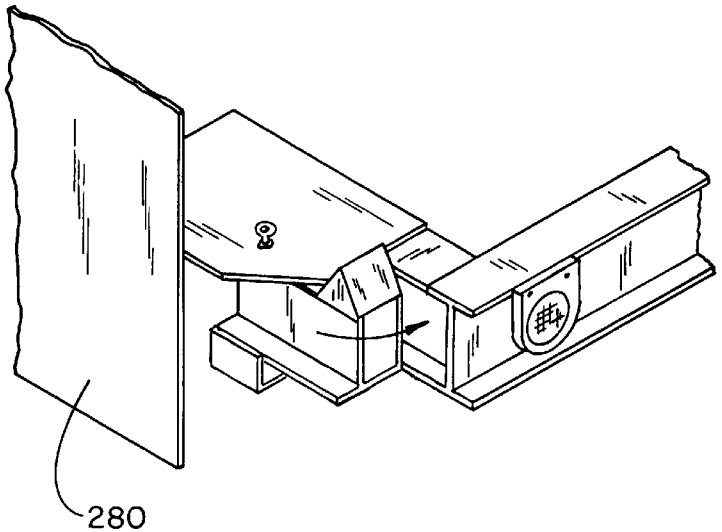
FIG. 6 is a close-up view of a carrier holding element.
Figure 5:
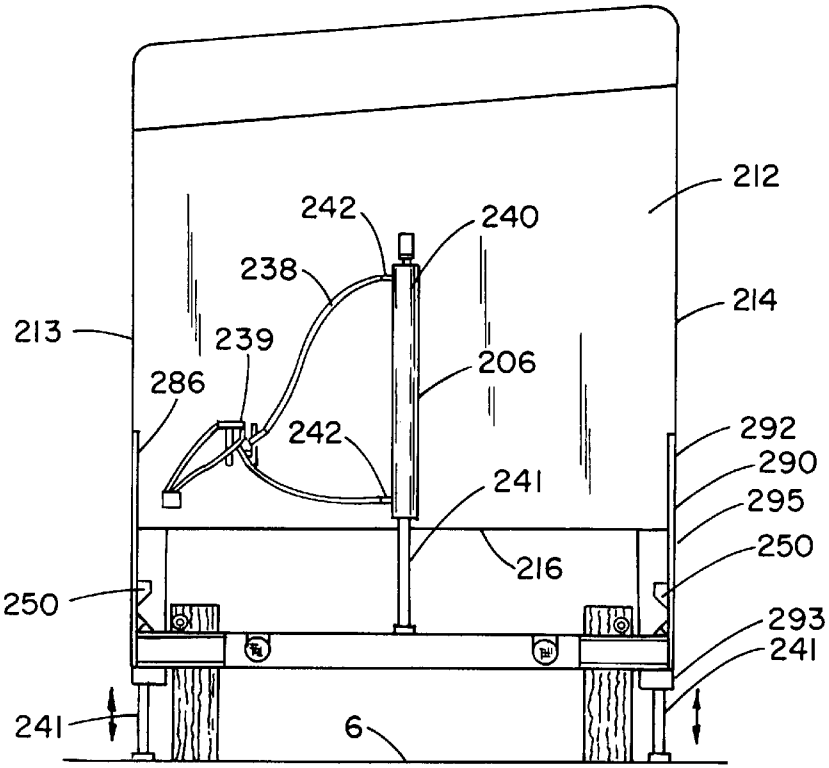
FIG. 5 is a rear view of the screening apparatus being lowered onto the carrier.
Figure 7:
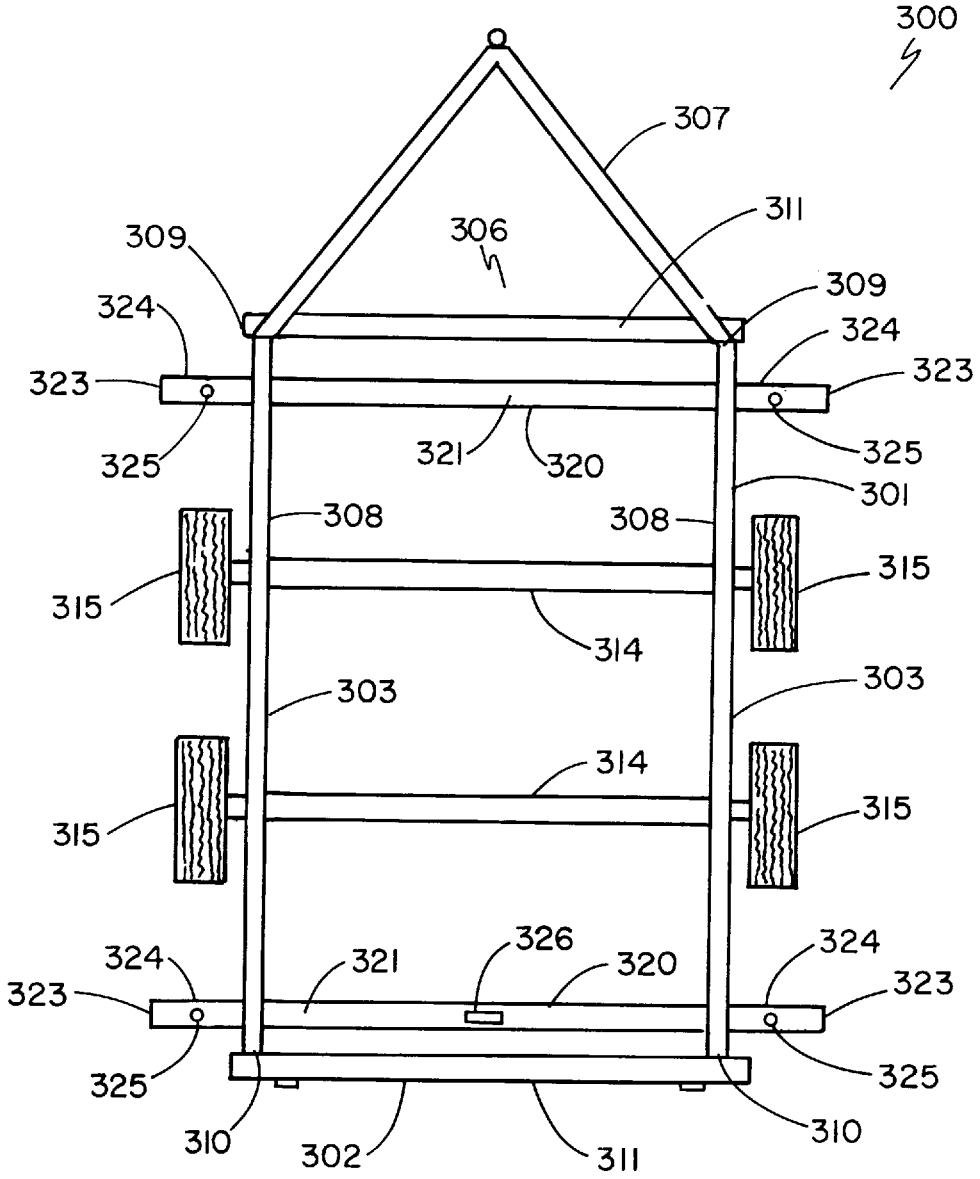
FIG. 7 is a top view of the invention carrier without the holding elements.
Figure 8:
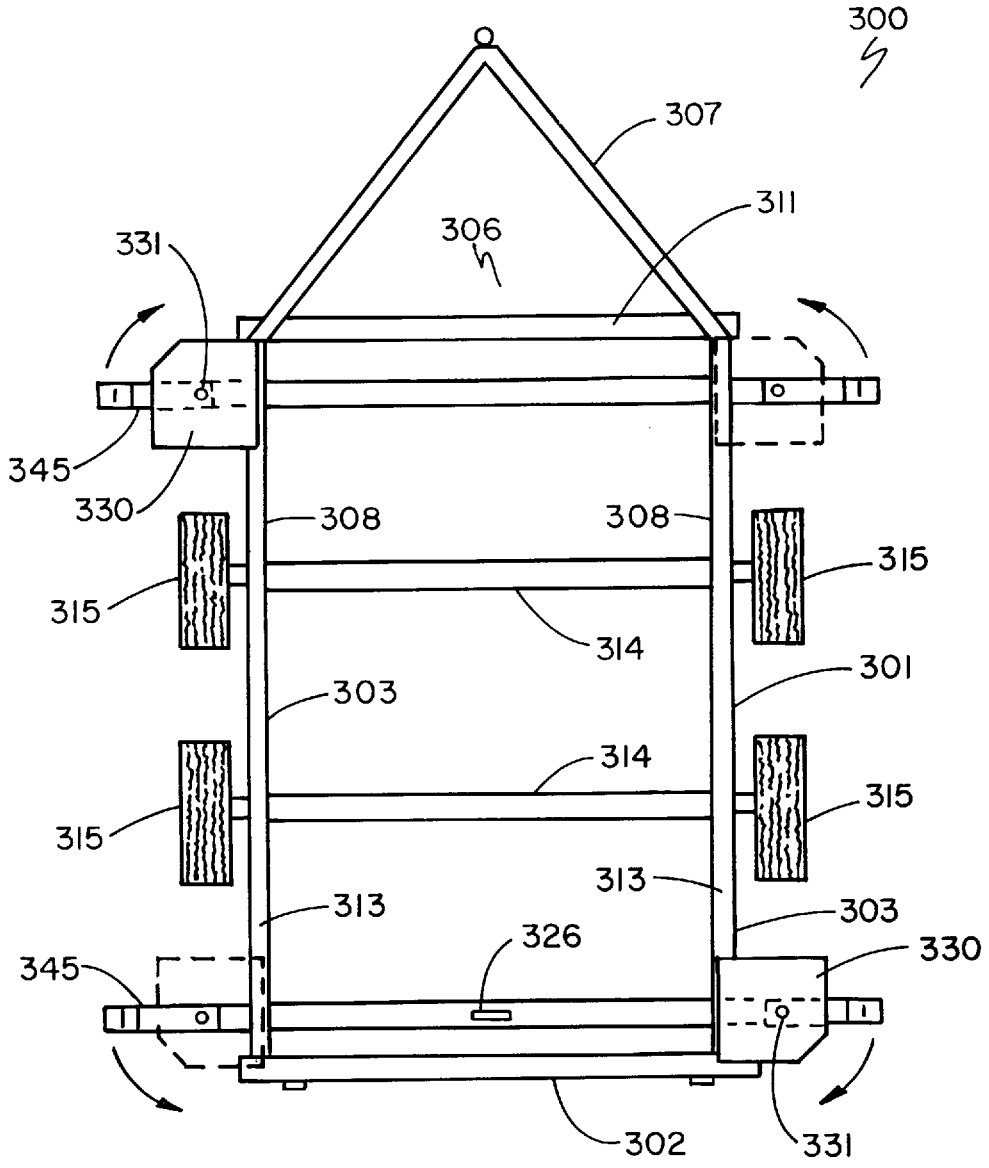
FIG. 8 is a top view of the invention carrier with the holding elements.
Figure 9:
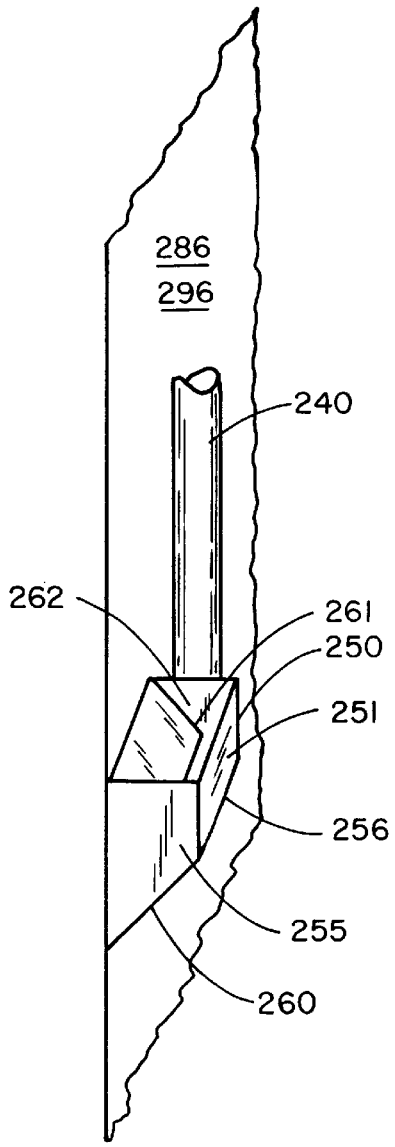
FIG. 9 is a close-up perspective view of a screening apparatus grasping element.
Figure 10:
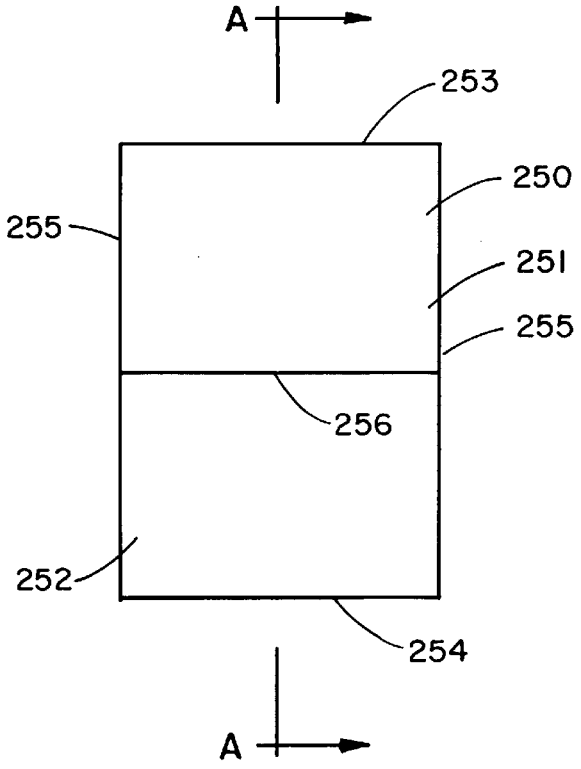
FIG. 10 is a front view of a screening apparatus grasping element.
Figure 11:
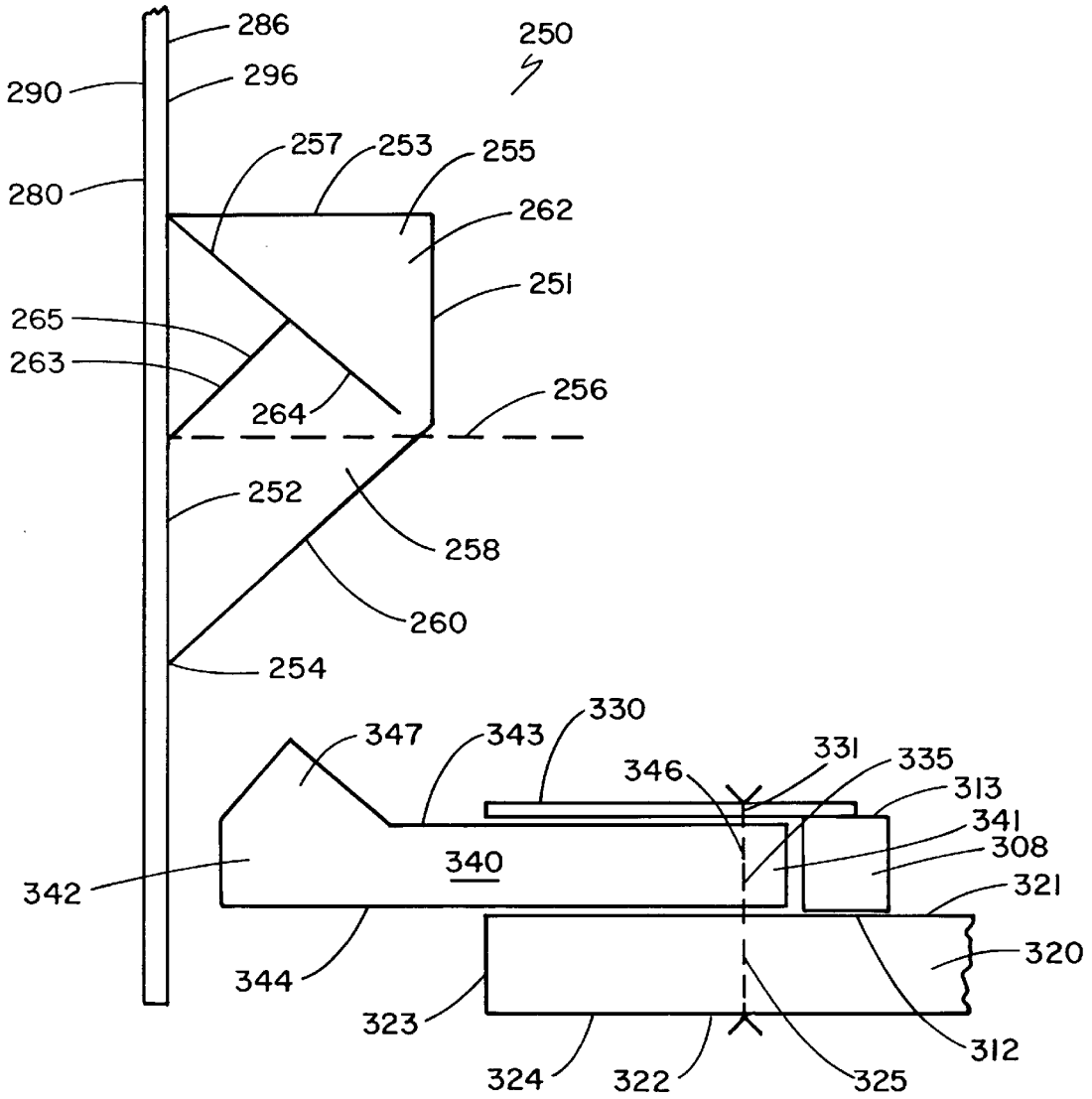
FIG. 11 is a cross-sectional view along the line A—A of FIG. 10 of a screening apparatus grasping element in conjunction with a carrier holding element.

The present invention 200 is comprised of a screening apparatus 210 in combination with a carrier 300. The screening apparatus 210 has a box-like shape with a vertical front end 211, a vertical rear end 212, a vertical tailings side 213, a vertical conveyor side 214, a top side 215 and a horizontal bottom side 216. The invention 200 longitudinal axis is coincident with an axis defined by the screening apparatus front end 211 and rear end 212.

The screening apparatus 210 includes a frame 220 for supporting a two-tiered screen assembly 221 for sifting materials. The screening apparatus 210 also includes a generally horizontal conveyer 201 installed just beneath the screen assembly 221 transverse to the invention 200 longitudinal axis. The screen assembly 221, comprising top 222 and bottom 223 screens, is sloped downwardly from the conveyer side 214 top side 215 to the tailings side 213 top side 215, and is supported at each corner by a C-shaped leaf spring (not shown) attached to the frame 220. A drive shaft (not shown) for vibrating the screen assembly 221 is driven by a hydraulic pump 231 mounted on an engine tray 230 installed on the screening apparatus front end 211. The shaft includes an off-balance counterweight (not shown) at each end to provide for eccentric rotation. The hydraulic pump 231 drives the shaft in a first rotational direction to move the materials down the screen assembly 221 in a sifting movement and in a second rotational direction to move the materials up the screen assembly 221 in a mixing movement. A crown 224 is provided in both the top and bottom screens 222, 223. The crown 224 provides a ridge which runs perpendicular to the tailings side 213. Longitudinal bars 225 for forming the crowned screens 222, 223 provide additional support to the screen assembly 221. The crowned shape of the screens 222, 223 disperses the materials more evenly on the screens. The screen assembly 221 is adjustably mounted on the frame 220 so that its slope can be adjusted. Moreover, the leaf springs are secured between side mounts on the screen assembly and mounting blocks secured to the frame 220 itself. In this way, the height of the frame 220 can be reduced while maintaining sufficient clearance below the screen assembly 221. The screening apparatus 210 is generally adapted to sift out tailings (debris and the like) and drop them out over the screening apparatus tailing side 213. The desired materials are sifted through the screen assembly 221 and deposited onto the conveyer 201 where the desired materials are moved to and dropped over the screening apparatus conveyer side 214.

The vertical tailings side 213 has a generally rectangular side-wall 280 having a front edge 281, a rear edge 282, a horizontal bottom edge 283, a horizontal top edge 284 formed just below the screening assembly conveyer 201, an outside surface 285 and an inside surface 286. The vertical conveyer side 214 has a generally rectangular side-wall 290 having a vertical front edge 291, a vertical rear edge 292, a horizontal bottom edge 293, a horizontal top edge 294 formed just below the screening assembly conveyer 201, an outside surface 295 and an inside surface 296. The side-wall inside surfaces 286, 296 are defined as those side-wall surfaces facing each other. Each side-wall 289, 290 extends forward beyond the screening apparatus front end 211 and rearward past the screening apparatus rear end 212.

This embodiment 200 of the invention also has an engine tray 230 mounted on the screening apparatus front end 211. The tray 230 has a generally rectangular shape and is positioned horizontally relative to the front end 211. The tray 230 is joined to said front end 211 and enclosed in a housing 229.

As stated above the hydraulic pump 231 is mounted on the engine tray 230. A hydraulic fluid tank 237 is mounted on the screening apparatus front end 211 above the engine tray 230. A network of hydraulic lines 238 interconnect the tank 237 and the hydraulic pump 231 with a number of hand-operated valves 239 mounted on the engine tray 230. The cables 238 then branch out from the valves 239 to their various operating terminals, i.e., hydraulic leg assemblies 204, 205, 206.

The screening apparatus 210 includes three hydraulic leg assemblies 204, 205, 206 for lifting and lowering the screening apparatus 210. One leg assembly 204 is attached to the apparatus front end 211 adjacent to the conveyer side side-wall inside surface 296. Another leg assembly 205 is attached to the apparatus front end 211 adjacent to the tailings side side-wall inside surface 286. The last leg assembly 206 is attached to the center of the screening apparatus rear end 212. Each leg assembly 204, 205, 206 has a vertical fluid cylinder 240, a piston 241 projecting downwardly from said cylinder 240, and two fluid inlet/ outlet ports 242 on each cylinder 240. The fluid inlet/outlet ports 242, i.e., operating terminals, are interconnected to the hand-operated valves 239 mounted on the engine tray 230 by hydraulic lines 238. Manipulation of the valves 239 will cause a reaction in the hydraulic leg assemblies 204, 205, 206 whereby the pistons 241 will extend outwardly or retract inwardly from the cylinders 240.

Each side-wall 280, 290 has two grasping elements 250 attached to the side-wall inside surface 286, 296, one grasping element 250 on each side-wall 280, 290 positioned between the side-wall's front edge 281, 291 and respective hydraulic leg assembly cylinder 240, a short distance up from the side-wall respective bottom edge 283, 293. The second of each grasping element 250 is attached adjacent to each side-wall's rear edge 282, 292 a short distance up from the side-wall respective bottom edge 283, 293. Each grasping element 250 has a vertical, hollow, box-like shape, with a front 251, rear 252, top 253, bottom 254 and two sides 255. The vertical axis of a grasping element 250 is from top 253 to bottom 254. The grasping element rear 252 is defined as that portion of the grasping element attached directly to the sidewall inside surface 286, 296. The grasping element front 251 is that portion of the grasping element horizontally opposite to the rear 252. The grasping element sides 255 are those two portions connecting the front 251 to the rear 252. The grasping element top 253 and bottom 254 are open. The grasping element front 251 extends vertically downward from the grasping element top 253 to a horizontal plane 256 midway along the vertical axis of the grasping element 250. The bottom 260 of each vertical side 255 extends from the grasping element bottom 254 at the grasping element rear 252 to the bottom 256 of the grasping element front 251. The grasping element 250 has a first, generally rectangular element 257 attached to the grasping element top 253 at the grasping element rear 252. The first rectangular element 257 extends into the interior 258 of the grasping element 250 toward the line 256 at the bottom of the grasping element front 251. The element 257 is attached along its sides 261 to the interior surfaces 266 of the grasping element sides 255. The grasping element 250 also has a second, generally rectangular element 263 attached to the grasping element rear 252 at the horizontal plane 256 midway along the vertical axis of the grasping element 250. The second rectangular element 257 extends into the interior 258 of the grasping element 250 up toward the top 253 of the grasping element front 251 to the undersurface 264 of the first rectangular element 257 where it is joined. The element 263 is also attached along its sides 265 to the interior surfaces 262 of the grasping element sides 255.

The carrier 300 is a trailer-type, towable device comprised of a generally rectangular frame 301 having a front 306, rear 302, two sides 303, top 304 and bottom 305. The carrier frame 301 has a V-shaped tow bar 307 attached to the frame front 306. The carrier frame longitudinal axis runs from the frame rear 302 through the frame front 306 and is parallel to the longitudinal axis of the screening apparatus 210. The carrier frame 301 has two horizontal, longitudinal beams 308, each having a forward end 309 and a rearward end 310. The longitudinal beams 308 are positioned parallel to the longitudinal axis of the carrier frame 301 and form the carrier sides 303. The longitudinal beams 308 are interconnected by two horizontal, transverse beams 311, one fixedly joined to the longitudinal beam forward ends 309 and the other fixedly joined to the longitudinal beam rearward ends 310, said transverse beams 311 forming the carrier frame front 306 and rear 302. The carrier frame 301 has two sets of axles 314 with wheels 315 attached to said carrier frame 301. The axles 314 are positioned transverse to the longitudinal axis of the carrier frame 301.

Two support beams 320 are attached to the bottom 305 of the carrier frame 301. Each support beam 320 has a top 321, a bottom 322 and two ends 323. Each support beam 320 is positioned transverse to the longitudinal axis of the carrier frame 301. The top 321 of one support beam 320 is welded to the bottom 312 of the longitudinal beams 308 near to the longitudinal beam forward ends 309. The top 321 of the other support beam 320 is welded to the bottom 312 of the longitudinal beams 308 near to the longitudinal beam rearward ends 310. Each support beam end 323 extends transversely outward past the carrier frame sides 303 an amount approximately equal to the thickness of the wheels 315, the portions of the support beams 320 extending outward past the carrier frame sides 303 being designated the support beam extension portions 324. Each support beam extension portion 324 has a vertical hole 325 formed therein near to the adjacent longitudinal beam 308.

Each longitudinal beam top 313 has a two horizontal plates 330 welded thereto, each said plate 330 extending sideways outward from the longitudinal beam top 313 over a support beam extension portion 324. Each plate 330 has a vertical hole 331 formed therein, said hole 331 being in vertical alignment with the vertical hole 325 formed in the support beam extension portion 324 directly below the plate 330.

The carrier 300 is further comprised of four elongated holding elements 340 each having two ends, a proximal end 341 and a distal end 342. Each holding element 340 also has a top 343, bottom 344 and two sides 345. Each holding element 340 has a vertical hole 346 formed therein near to its proximal end 341. Each holding element 340 is positioned between a support beam extension portion 324 and corresponding plate 330 where it is pivotally connected by means of a rod-like element 335 inserted through the plate vertical hole 331, through the holding element vertical hole 346, and through the support beam extension portion vertical hole 325. The holding element distal end 342 has a wedge-shaped protrusion 347 formed on the holding element top. The wedge-shaped protrusion 347 generally corresponds in shape to the grasping element interior 258 from the grasping element bottom 254 as modified by the rectangular elements 257 and 263.

In operation, the screening apparatus 210 rests on the ground 6, the screening apparatus tailings sidewall bottom edge 283 and conveyer side sidewall bottom edge 293 actually engaging the ground 6. The pistons 241 of the hydraulic leg assemblies 204, 205, 206 are generally retracted into the hydraulic leg assembly cylinders 240. When it is desired to move the screening apparatus 210 a carrier 300 is slid under the screening apparatus bottom side 216. The carrier holding elements 340 are initially positioned so that their longitudinal axes are parallel to the longitudinal axis of the carrier 300. The front hydraulic leg assemblies 204, 205 are activated and the leg assembly pistons 241 extended out from the cylinders 240 in a vertically downward direction thereby lifting the screening apparatus front end 211 vertically upward so that the two front grasping elements 250 are vertically higher than the carrier front holding elements 340. The front hydraulic leg assemblies 204, 205 are designed so that their pistons 241 reach the ground. The front holding elements 340 are then horizontally pivoted by hand so that their longitudinal axes are transverse to the carrier longitudinal axis. This will position the front holding element distal ends 342 vertically below the screening apparatus front grasping elements 250. The hydraulic leg assemblies 204, 205 are then activated again, withdrawing the pistons 241 into the cylinders 240 thereby causing the screening apparatus front end 211 to be lowered. The lowering action will cause the holding element wedge-shaped protrusions 347 to engage the grasping element bottoms 254 into the grasping element interiors 258 and against the rectangular elements 257 and 263. The rear hydraulic leg assembly 206 is then activated and the leg assembly piston 241 extended out from the cylinder 240 in a vertically downward direction to engage the center 326 of the rear support beam 320 thereby lifting the screening apparatus rear end 212 vertically upward so that the two rear grasping elements 250 are vertically higher than the two carrier rear holding elements 340. The rear hydraulic leg assembly 206 is shorter that the front leg assemblies 204, 205 and designed specifically so that it cannot reach the ground 6 but rather only to the carrier rear support beam 320. The rear holding elements 340 are then horizontally pivoted by hand so that their longitudinal axes are transverse to the carrier longitudinal axis. This will position the rear holding element distal ends 342 vertically below the screening apparatus rear grasping elements 250. The rear hydraulic leg assembly 206 is then activated again, withdrawing the piston 241 into the cylinder 240 thereby causing the screening apparatus rear end 212 to be lowered. The lowering action will cause the holding element wedge-shaped protrusions 347 to engage the grasping element bottoms 254 into the grasping element interiors 258 and against the rectangular elements 257 and 263. The screening apparatus 210 is thereby secured to the carrier 300 for towing. To remove the screening apparatus 210 from the carrier 300, the above procedure is reversed. The shapes of the holding element protrusions 347 and grasping element interiors 258 provide a self-aligning capability to the screening apparatus-carrier combination of the present invention. The use of three hydraulic leg assemblies rather than four, and the use of a shortened rear hydraulic leg assembly, make the screening apparatus 210 difficult to remove without the proper carrier 300, thereby reducing theft.

It is understood that the above-described embodiment is merely illustrative of the application. Other embodiments may be readily devised by those skilled in the art which will embody the principles of the invention and fall within the spirit and scope thereof.

I claim:

1. A screening apparatus for separating fine materials from coarse materials in a shaker mode and for mixing two or more fine materials together in a mixer mode, in combination with a carrier, comprising:

a screening apparatus having a box-like shape with a vertical front end, a vertical rear end, a vertical tailings side, a vertical conveyor side, a generally horizontal top side and a horizontal bottom side, said screening apparatus having a longitudinal axis defined by said front end and said rear end, said screening apparatus further comprising:

a frame within said screening apparatus, said frame having a two-tiered screen assembly for sifting and mixing materials;

a generally horizontal conveyer attached within said frame beneath the screen assembly transverse to the screening apparatus longitudinal axis;

an engine tray mounted on the screening apparatus front end;

a hydraulic pump mounted on the engine tray;

a hydraulic fluid tank mounted on the screening apparatus front end above the engine tray;

a plurality of hydraulic lines interconnecting said hydraulic fluid tank and said hydraulic pump with a plurality of hand-operated valves attached to said screening apparatus, said cables branching out from said valves to three hydraulic leg assemblies;

three hydraulic leg assemblies attached to said screening apparatus and adapted for lifting and lowering said screening apparatus, one of said leg assemblies being attached to the apparatus front end adjacent to the conveyer side, another of said leg assemblies being attached to the apparatus front end adjacent to the tailings side, and the last of said leg assemblies being attached to the center of the apparatus rear end, each said leg assembly having a vertical fluid cylinder, a piston projecting downwardly from said cylinder, and fluid inlet/ outlet ports on said cylinder, said fluid inlet/outlet ports being interconnected to hydraulic lines connected to said hand-operated valves wherein manipulation of the valves will cause a reaction in the hydraulic leg assemblies whereby the pistons will extend outwardly or retract inwardly from the cylinders;

four grasping elements, two of said grasping elements being fixedly attached to the tailings side, one near the front and one near the rear, and two being fixedly attached to said conveyor side, one near the front and one near the rear, each said grasping element having a wedge-shaped interior;

in combination with:

a trailer-type, towable carrier, comprising:

a generally rectangular frame having a front, rear, two sides, top and bottom, and a longitudinal axis running from the frame rear through the frame front, said carrier frame longitudinal axis being parallel to the longitudinal axis of the screening apparatus;

a V-shaped tow bar attached to the frame front;

four elongated holding elements each having two ends, a proximal end and a distal end, two of said holding elements being pivotally attached to each side, one near the front and one near the rear, each said holding element distal end having a wedge-shaped protrusion formed on the holding element extending vertically upward, said wedge-shaped protrusion generally corresponding in shape to the grasping element interior.

2. A combination as recited in claim 1, wherein:

said vertical tailings side and said vertical conveyor side each have a generally vertical, rectangular side-wall having a front edge, a rear edge, a horizontal bottom edge, a horizontal top edge formed just below the screening assembly conveyer, an outside surface and an inside surface, said side-wall inside surfaces being defined as those side-wall surfaces facing each other, each side-wall extending forward beyond the screening apparatus front end and rearward past the screening apparatus rear end.

3. A combination as recited in claim 2, wherein:

each said side-wall has two said grasping elements attached to the side-wall inside surface, one grasping element on each side-wall being positioned between the side-wall's front edge and respective hydraulic leg assembly cylinder, a short distance up from the side-wall respective bottom edge, the second of each grasping element being attached adjacent to each side-wall's rear edge a short distance up from the side-wall respective bottom edge.

4. A combination as recited in claim 3, wherein:

each grasping element has a vertical, hollow, box-like shape, with a front, rear, top, bottom and two sides defining an interior, each said grasping element having a vertical axis of a grasping element defined from top to bottom, each said grasping element rear being defined as that portion of the grasping element attached directly to the sidewall inside surface, said grasping element front being that portion of the grasping element horizontally opposite to the rear, said grasping element sides being those two portions connecting the front to the rear, each said grasping element top and bottom being open, said grasping element front extending vertically downward from the grasping element top to a horizontal plane midway along the vertical axis of the grasping element, each said grasping element side having a bottom extending from the grasping element bottom at the grasping element rear to the bottom of the grasping element front.

5. A combination as recited in claim 4, wherein each said grasping element is further comprised of:

a first, generally rectangular element attached to the grasping element top at the grasping element rear, said first rectangular element extending into the grasping element interior toward the line at the bottom of the grasping element front, said first rectangular element being attached along its sides to the interior surfaces of the grasping element sides; and a second, generally rectangular element attached to the grasping element rear at the horizontal plane midway along the vertical axis of the grasping element, said second rectangular element extending into the grasping element interior up toward the top of the grasping element front to the undersurface of the first rectangular element where it is joined, said second element being attached along its sides to the interior surfaces of the grasping element sides.

6. A combination as recited in claim 5, wherein said carrier frame is further comprised of:

two horizontal, longitudinal beams, each having a forward end, a rearward end, a top, a bottom and two sides, said longitudinal beams being positioned parallel to the longitudinal axis of the carrier frame forming said carrier sides;

two horizontal, transverse beams interconnecting said longitudinal beams, one said transverse beam fixedly joined to the longitudinal beam forward ends and the other said transverse beam fixedly joined to the longitudinal beam rearward ends, said transverse beams forming the carrier frame front and rear;

two sets of axles with wheels, said axles being attached to said longitudinal beams and being positioned transverse to the longitudinal axis of the carrier frame, said wheels being outside the carrier frame sides; and two support beams attached to the bottom of the carrier frame, each support beam having a top, a bottom and two ends, each support beam being positioned transverse to the longitudinal axis of the carrier frame, said top of one support beam being welded to the bottom of the longitudinal beams near to the longitudinal beam forward ends, said top of the other support beam being welded to the bottom of the longitudinal beams near to the longitudinal beam rearward ends, each support beam end extending transversely outward past the carrier frame sides an amount approximately equal to the thickness of the wheels, the portions of the support beams extending outward past the carrier frame sides being designated the support beam extension portions, each support beam extension portion having a vertical hole formed therein near to the adjacent longitudinal beam; and two horizontal plates welded to each longitudinal beam top, each said plate extending sideways outward from the longitudinal beam top over a support beam extension portion, each said plate having a vertical hole formed therein, said hole being in vertical alignment with the vertical hole formed in the support beam extension portion directly below the plate.

7. A combination as recited in claim 6, wherein:

each said carrier holding element has a top, bottom and two sides, each said holding element having a vertical hole formed therein near to its proximal end, each said holding element being positioned between a support beam extension portion and corresponding plate whereby said holding element is pivotally connected by means of a rod-like element inserted through the plate vertical hole, through the holding element vertical hole, and through the support beam extension portion vertical hole, said holding element distal end having said wedge-shaped protrusion formed on the holding element top, said wedge-shaped protrusion generally corresponds in shape to the grasping element interior from the grasping element bottom as modified by the rectangular elements.

* * * * *